United States Patent [19]

McNally

[11] 4,387,831

[45] Jun. 14, 1983

[54] CONTAINER FOR DISPENSING ARTICLES CARRIED ON A WEB

[75] Inventor: John F. McNally, 60 Venetian Dr. N101, Delray Beach, Fla. 33444

[73] Assignee: Claire O. McNally, Delray Beach, Fla.

[21] Appl. No.: 217,552

[22] Filed: Dec. 17, 1980

[51] Int. Cl.[3] ..... B65H 5/28

[52] U.S. Cl. ..... 221/25; 221/70

[58] Field of Search ..... 221/25, 30, 69, 70, 221/71–74, 307; 242/55.3; 225/42, 52

[56] References Cited

U.S. PATENT DOCUMENTS

| | | | |
|---|---|---|---|
| 730,960 | 6/1903 | Pape | 221/25 X |
| 2,462,816 | 2/1949 | Schner et al. | 221/25 X |
| 3,051,583 | 8/1962 | Tindall | 221/25 X |
| 3,115,989 | 12/1963 | Strang | 221/25 |
| 3,131,830 | 5/1964 | Schaef | 221/25 |
| 3,325,050 | 6/1967 | Wanamaker | 221/25 |
| 4,162,739 | 7/1979 | Nelson | 221/70 |

FOREIGN PATENT DOCUMENTS

| | | | |
|---|---|---|---|
| 1459035 | 10/1966 | France | 221/25 |

*Primary Examiner*—Stanley H. Tollberg

*Attorney, Agent, or Firm*—Nims, Howes, Collison & Isner

[57] ABSTRACT

A dispenser for dispensing articles carried on a web, the dispenser comprising a web, articles carried on the web, and a container for containing the web, the container having an aperature in a wall thereof for permitting the discharge of the web therefrom, and the container provided with a foldable flap, which flap is folded to form a ridge depending from the interior surface of a container wall in a region near the aperature, whereby the ridge inhibits the discharge of the web from the containers. The dispenser may additionally include a receptable for receiving and supporting the container, at least part of the receptable being deformable, the deformable part defining at least a portion of an orifice through which the web discharged from the container extends, the deformable part inhibiting the discharge of the web from the container.

6 Claims, 13 Drawing Figures

CONTAINER FOR DISPENSING ARTICLES CARRIED ON A WEB

BACKGROUND OF THE INVENTION

In modern retail stores, most goods are displayed for sale by hanging them on a rack or the like, by stacking them individually on a shelf, by placing them in bins, or by placing the box in which the goods are shipped on a shelf and opening the box to expose the goods. Moreover, the goods are usually placed between one foot and six feet above the store floor so that the goods may be readily seen and easily reached by a prospective purchaser. The foregoing methods of displaying goods for sale greatly underutilize store space, demand a substantial amount of labor in unpacking, arranging and rearranging the goods, create difficulties for inventory control, invite pilfering, and result in the scattering, toppling, etc. of the goods into an unesthetic display.

SUMMARY OF THE INVENTION

The present invention resulted from efforts to overcome the above-recited disadvantages associated with present methods of displaying goods for sale, especially the so-called "impulse" items that are displayed near a store's check-out counter. Accordingly, the present invention contemplates a new way of displaying goods for sale and also contemplates a new way of packaging goods for such display.

In one embodiment of the present invention several webs each containing a series of packets and each packet enclosing an article for sale, are contained in a dispenser positioned at least six feet above the store's floor. An end of each web dangles from the dispenser so that some packets of each web may be viewed readily by a customer and so that a customer may easily pull down and tear off the desired number of packets to purchase the articles enclosed therein. To prevent the entire web from running out of the dispenser when the customer pulls down the web, the dispenser is provided with means for inhibiting movement of the web except when a force such as is generated by a customer's pull is applied to the web. Each web may be packed in and an end thereof connected to a cardboard box having an aperture in a wall thereof for permitting the discharge of the web therefrom, and provided with a foldable flap which is folded to form a ridge depending from the interior surface of a box wall in a region near the aperture, which ridge inhibits, but does not prevent, the discharge of said web. The dispenser is adapted to receive and support a plurality of such boxes.

Several advantages of the above-summarized embodiment of the present invention over prior packaging and display techniques are evident. The manufacturer or distributor of the goods may attach the goods to a web, package the web in a box, and ship the box to the retail store, whereafter nominal labor requiring no special skill is needed to place the box in, and display the goods attached to the web from, the dispenser. The goods will never be toppled or scattered, but rather, are always presented in a neat arrangement. The dispenser is locatable in presently unutilized store space, thereby increasing the cost efficiency of the store's operation. The dispenser is especially suited for positioning near the check-out counter of a store, where the articles may be displayed at eye level directly in view of customers as they wait in line. A dispenser so located is particularly useful for displaying "impulse" purchase items such as batteries, razor blades, pens and lipstick and particularly those items presently costing one dollar or more for cost efficiency. Moreover, pilfering is reduced because the dispenser is in a position that sharply exposes anyone's attempt to reach the web and tear off a selected number of goods, especially when the dispenser is mounted near the check-out counter of a store, and because the dispenser is adapted for small sized items that are usually subject to pilferage.

Because the dispenser is positioned in a high region, it may also be used to support a mirror or a camera for security or a television screen for advertising.

For a better understanding of the invention and the attendant advantages thereof, reference may be made to the following descriptions of representative embodiments taken in conjunction with the figures of the accompanying drawings in which:

DESCRIPTION OF PREFERRED EMBODIMENTS

Figure 1:
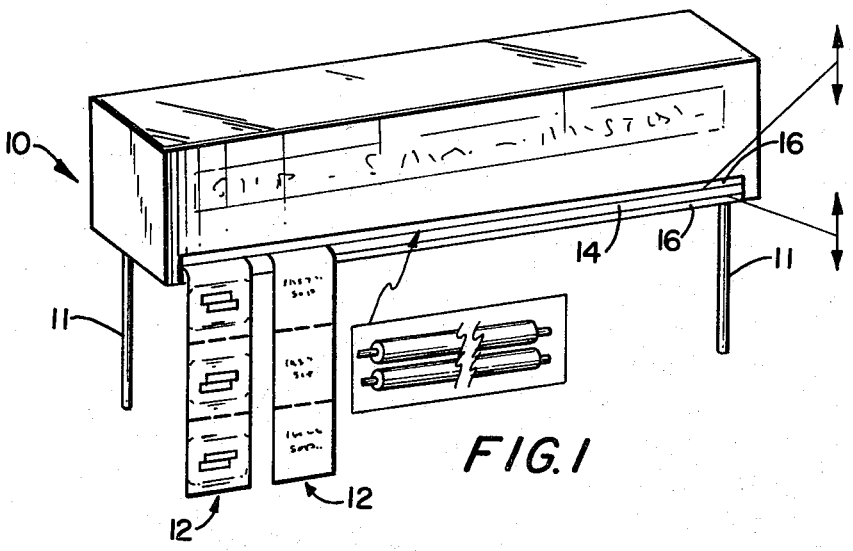
FIG. 1 shows oblique view of a dispenser for dispensing articles carried on a web according to the present invention.

There is shown in FIG. 1 a dispenser comprising a box-like receptacle 10 which can be supported from a floor or a counter by mounting rods 11 and brackets or from a ceiling by wires, chains, or the like. In the receptacle 10, several webs 12 each carrying articles for sale are stored and dispensed for display.

The webs 12 may be stored in the receptacle 10 by folding each web 12 in a back and forth manner, by winding each web 12 on a reel, or by placing each web 12 in a container, the properties of which will be discussed subsequently herein. A portion of each web 12, and therefore the articles carried on that web portion, are displayed by extending the leading end of each web 12 through an orifice 14 provided in a receptacle wall.

When a customer desires a selected number of articles on a web 12, the customer pulls down the leading web end and severs from the web 12 a web portion carrying the selected number of articles thereon. After such pulling and severing a newly formed leading web end extends through the orifice 14 for display. This process will be repeated by customers until the web 12 is entirely used up.

When a customer pulls on the leading web end to obtain the selected number of articles, the web 12 has a tendency to "avalanche" through the orifice 14 after the pulling force has been applied, and consequently too much of the web 12 is displayed. Therefore the receptacle 10 is provided with means for prohibiting such "avalanching", which as shown in FIG. 1, preferably comprises a pair of flexible rubber tongues 16 each disposed on a side of and partially defining the orifice 14. Each web 12 is compressed between the tongues 16, which allow a web 12 to pass therebetween only when a sufficiently strong pulling force is applied to the leading web end. Optionally, the tongues 16 can be replaced by foam rubber rollers, or only a single tongue 16 or roller can be used. The receptacle 10 also may be provided with a pressure bar against which each web 12 may be pressed to facilitate the severance of the web 12. Preferably the tongues 16 or rollers may be adjustably positioned to alter the size of the orifice 14 for accommodating different web and article thicknesses. It has also been found that "avalanching" is inhibited if the receptacle 10 is tilted about fifteen degrees from the vertical.

To allow the trailing end of each web 12 to be displayed, each web trailing end is connected by a web extension ribbon, and attached by suitable means to, the inside surface of the receptacle 10, the reel, or the like. When the ribbon extends through the orifice 14, the web 12 is exhausted, and thus the ribbon signals that a new web should be placed in the receptacle 1. Optionally the ribbon may be printed with advertisements.

Figure 2:
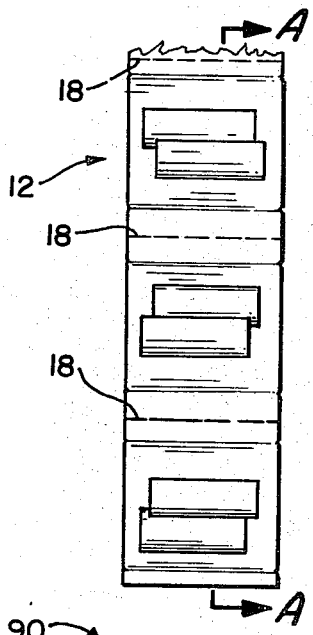
FIG. 2 is a front view of a portion of a web carrying articles that may be used in accordance with the present invention.
Figure 3:
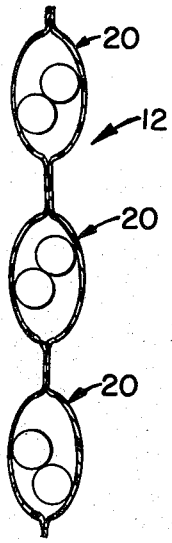
FIG. 3 is a cross sectional view of the web portion of FIG. 2 taken along line A—A.

The web 12 may be fashioned of flexible paper, plastic or the like and the articles may be carried thereon, preferably equidistantly therealong, by stapling, glueing, blister sealing, etc. Moreover, as shown in FIG. 2, the web 12 preferably is provided with a series of laterally extending, longitudinally spaced scored or perforated lines 18 to permit the easy severance of the web 12. As shown in FIG. 3, the web preferably is provided with a series of pouches 20 in which the articles are enclosed, with a score line 18 located between adjacent pouches 20.

Figure 4:
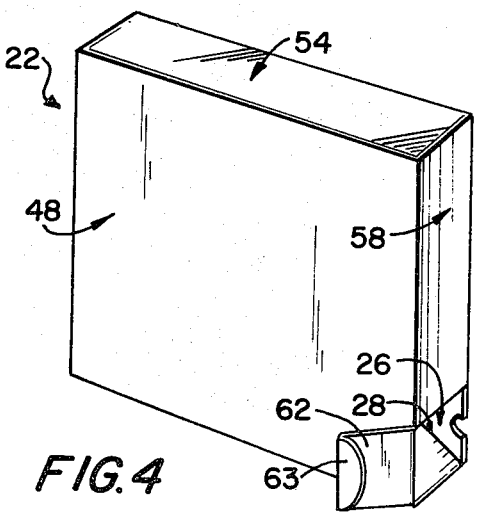
FIG. 4 shows oblique view of a carton for containing and shipping a web such as shown in FIG. 1, FIG. 2, and FIG. 3 according to the present invention.

There is shown in FIG. 4 a carton for promoting the packaging, shipping and handling of the web 12. The carton comprises a generally rectangular box 22 formed primarily of corrugated paper or cardboard. The box 22 may of course be fashioned in a hexagonal, octagonal, or other shape. A side wall of the box 22 may be provided with a window covered by a transparent plastic sheet adhering to the wall inside surface adjacent to the window. The box 22 is further provided with a selectively closeable discharge opening 26 in an end wall thereof and with a ridge 28 depending from the interior of the box 22 in a region near the discharge opening 26.

Figure 6:
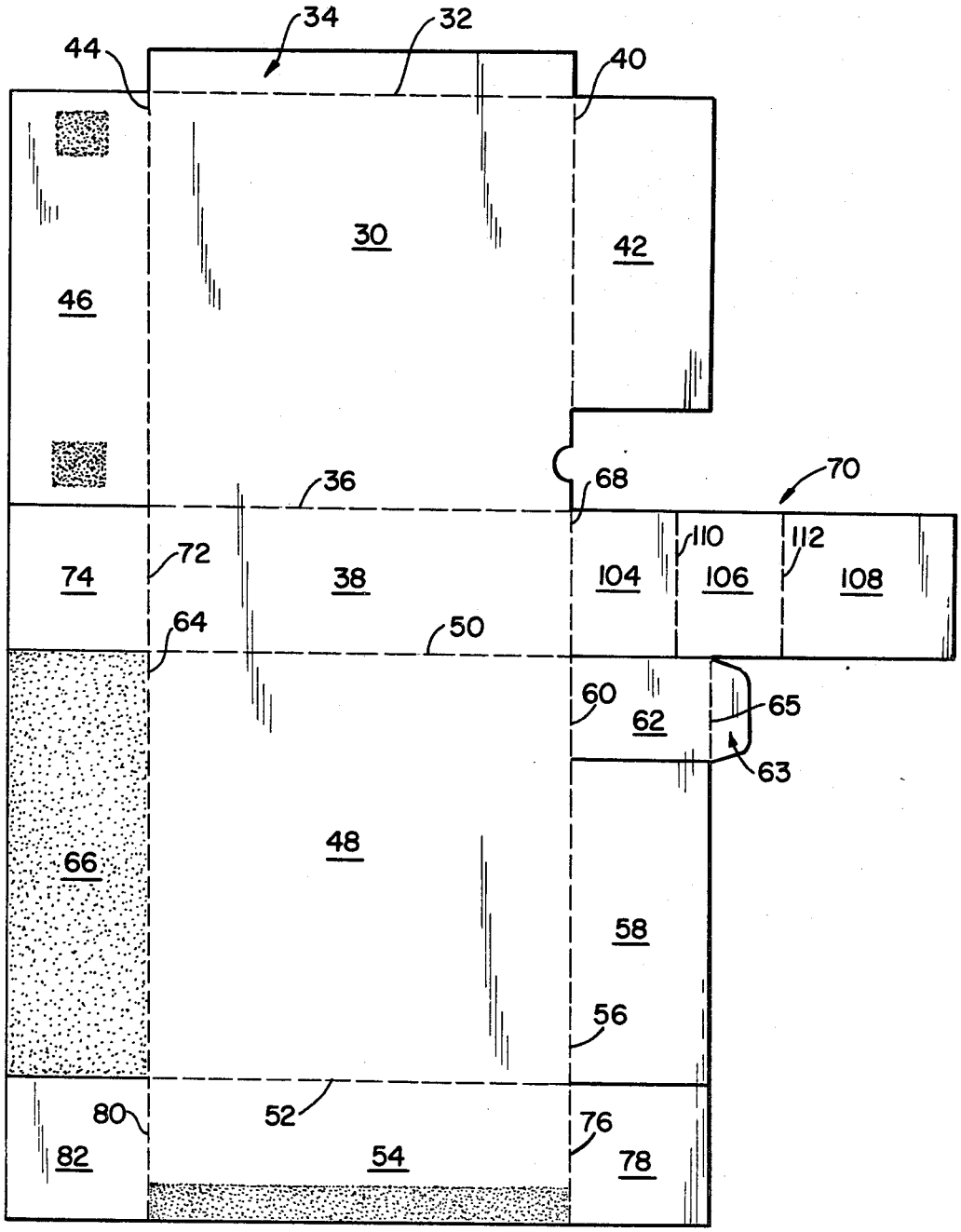
FIG. 6 shows a blank that may be folded to form the carton shown in FIG. 4.

FIG. 6 shows a blank that may be used to construct the box 22. The blank includes a rectangular first side wall 30 connected at one border along fold line 32 to a rectangular top wall tab 34 and at the opposite border along fold line 36 to a rectangular bottom wall 38. The first side wall 30 is connected at a third border thereof along fold line 40 to a first side wall front flap 42 and at the fourth border thereof along a fold line 44 to a first side wall back flap 46. The blank further includes a rectangular second side wall 48 connected to one border along fold line 50 to the bottom wall 38, opposite to the fold line 36 connecting the first side wall 30 and the bottom wall 38, and at the opposite border along fold line 52 to a rectangular top wall 54. The second side wall 48 is connected at a third border thereof along fold line 56 to a second side wall front flap 58 and along fold line 60 to a discharge opening closure tab 62, the closure tab 62 having a tongue 63 connected thereto along fold line 65, and at the fourth border thereof along fold line 64 to a second side wall back flap 66. The bottom wall 38 is connected at a third border thereof along fold line 68 to a foldable ridge-forming flap 70 and at the fourth border thereof along fold line 72 to a bottom wall back flap 74. The top wall 54 is connected at a third border thereof along fold line 76 to a top wall front flap 78 and at the fourth border thereof along fold line 80 to a top wall back flap 82.

The carton shown in FIG. 4 may be constructed from the blank shown in FIG. 6 as follows. The blank is folded along lines 32, 36, 50, and 52 and then the top wall 54 is overlapped with the top wall tab 34, the top wall 54 being provided with an adhesive in the region of overlapping to secure the same to the top wall tab 34. Next, the bottom wall back flap 74 and the top wall back flap 82 are folded along lines 72 and 80, respectively, and then the first side wall back flap 46 is folded along line 44 and overlapped with the top wall back flap 74 and the top wall back flap 82, the first side wall back flap 46 being provided with an adhesive in the region of overlapping to secure the same to the overlapped flaps. Thereafter, the second side wall back flap 66 is folded along line 64 and to overlap the first side wall back flap 46, the second side wall back flap 66 being provided with adhesive in the region of overlapping to secure the same to the first side wall back flap 46. Finally, the ridge-forming flap 70 is folded in a manner to be described hereinafter.

Figure 13:
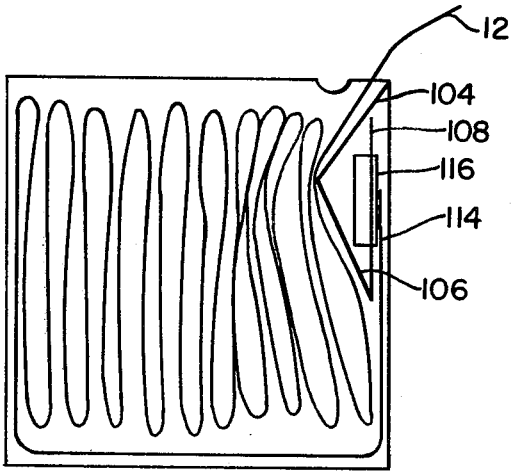
FIG. 13 is a schematic representation of a cross-sectional view of the carton shown in FIG. 4 filled with a folded web, taken in a plane midway between the side walls of the carton.

When the box 22 has been so assembled, the web 12 is packaged therein by folding the same in a back and forth manner (such as shown in FIG. 13) or by winding the same on a reel, leaving the leading web end near the area of the discharge opening 26. The box 22 is then assembled for shipping and storage as follows. The top wall front flap 78, the second side wall front flap 58, and the first side wall front flap 42 are folded along lines 76, 56, and 40, respectively, in an overlapping manner, thereby forming the discharge opening 26, and thereafter the discharge opening closure tab 62 is folded along line 60 and the tab tongue 63 folded along line 65 to close the discharge opening 26.

Figure 5:
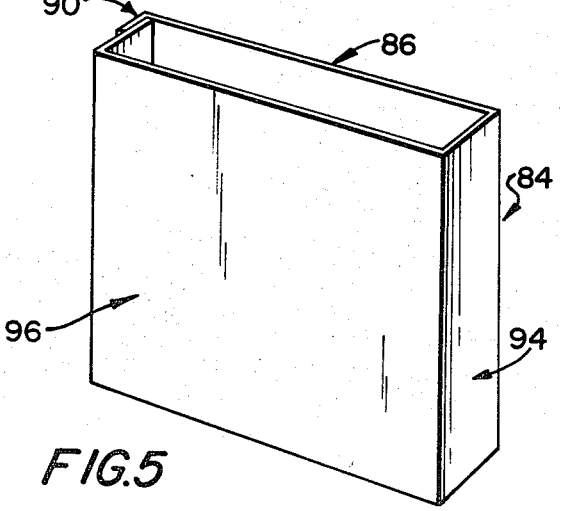
FIG. 5 shows oblique view of a sleeve into which the carton shown in FIG. 4 may slide for handling and shipping of the carton.

The last recited group of folded tab and flaps may be prevented from unfolding and allowing the web 12 to spill out of the box 22 by inserting the box 22 into a tight fitting shipping sleeve 84, as shown in FIG. 5. The shipping sleeve 84 also is formed primarily of corrugated paper or cardboard.

Figure 7:
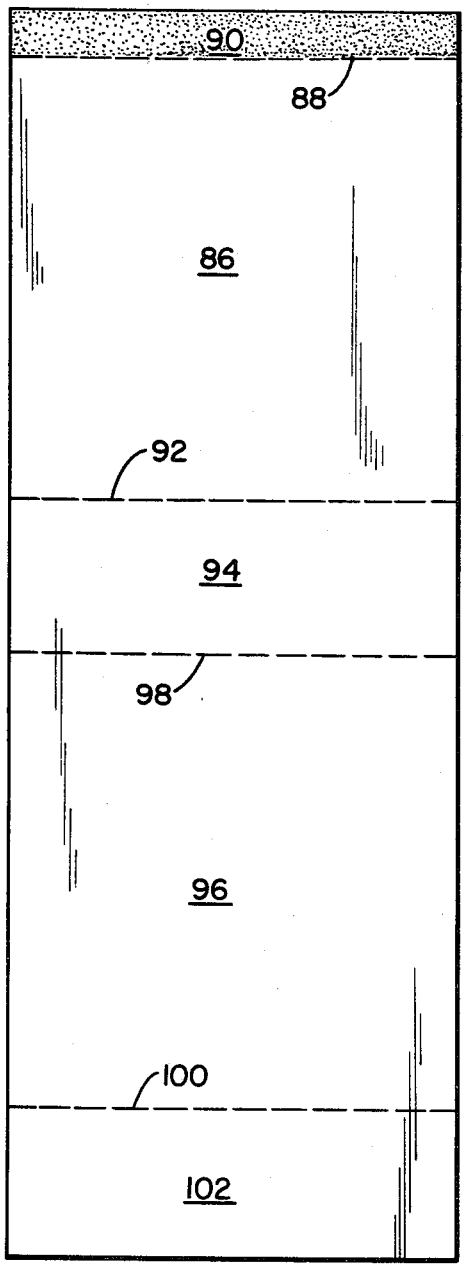
FIG. 7 shows a blank that may be folded to form the sleeve shown in FIG. 5.
Figure 8:
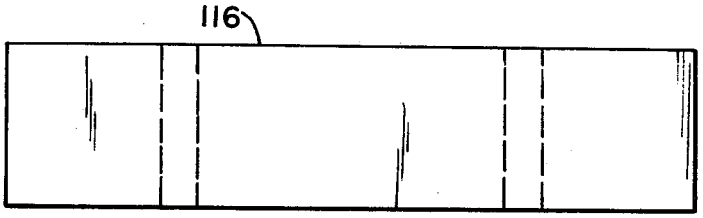
FIG. 8 shows a blank that may be folded to form a "C" shaped connector for securing a web to the carton shown in FIG. 4.
Figure 9:
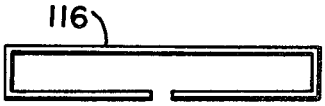
FIG. 9 is an end view of a "C" shaped connector formed by folding the blank shown in FIG. 8.
Figure 10:
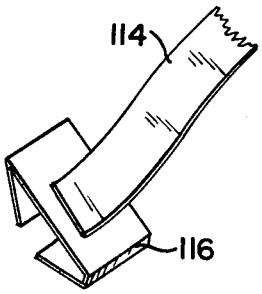
FIG. 10 is a perspective view of a web portion attached to the "C" shaped connector shown in FIG. 9.
Figure 11:
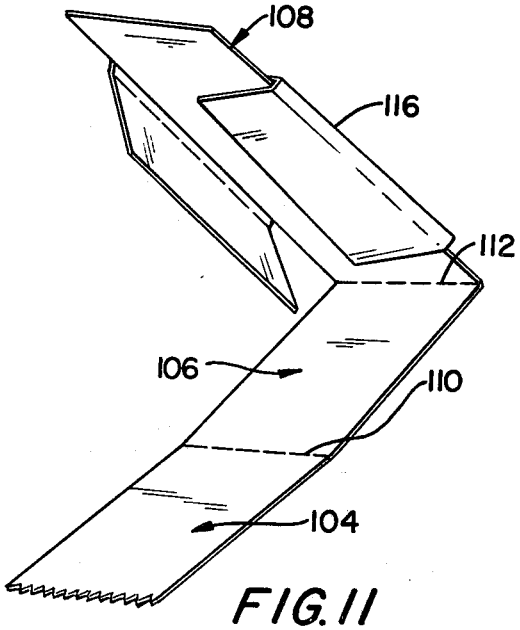
FIG. 11 illustrates an intermediate step in securing the "C" shaped connector shown in FIG. 9 and FIG. 10 to a flap of the carton shown in FIG. 4.
Figure 12:
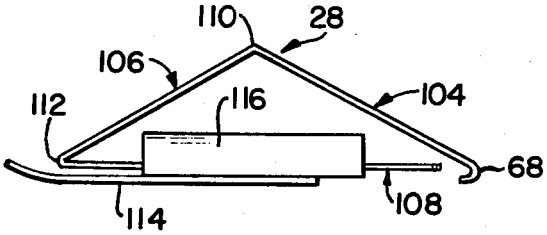
FIG. 12 is a side view of the connector shown in FIG. 9 FIG. 10, and FIG. 11 secured to the flap shown in FIG. 11.

FIG. 7 shows a blank that may be used to construct the sleeve 84. The blank includes a rectangular first side wall 86 connected at one border along fold line 88 to a rectangular back wall tab 90, and at the opposite border along fold line 92 to a rectangular front wall 94. The blank further includes a rectangular second side wall 96 connected at one border along fold line 98 to the front wall 94, opposite to the fold line 92 connecting the first side wall 86 and the front wall 94, and at the opposite border along fold line 100 to a rectangular back wall 102. The sleeve 84 is formed from the blank by folding the blank along lines 88, 92, 98, and 100, and then the back wall tab 90 is overlapped with the back wall 102, the top wall tab 90 being provided with an adhesive in the region of overlapping to secure the same to the back wall 102.

The box 22 with the surrounding sleeve 84 may be shipped to a retail store where the sleeve 84 is removed and the closure tab 62 unfolded to form the box discharge opening 26. The box 22 is then placed in the receptacle 10 so that the front flaps 78 58, and 42 are maintained in a folded position by abutment with the interior surface of a receptacle wall and so that the leading web edge can be easily routed out the box discharge opening 26 and through the receptacle orifice 14. Thus, it will be appreciated that the discharge opening 26 may be located in a variety of areas on the box 22, the box 22 may assume several different orientations, and the orifice 14 may be located in a variety of areas in the receptacle 10 to achieve an easy web routing, e.g., the box 22 shown in FIG. 4 may be turned upside down and the orifice 14 located near the top edge of the receptacle wall.

As previously stated, the box 22 is provided with a ridge 28 depending from the interior box surface in a region near the discharge opening 26, the purpose of the ridge 28 being to inhibit "avalanching" of the web 12 after the web 12 has been pulled. The ridge 28 may be formed by folding the ridge-forming flap 70. As shown in FIG. 6, FIG. 11, FIG. 12, and FIG. 13, the ridge-forming flap 70 is comprised of a rectangular first section 104, a rectangular intermediate section 106, and a rectangular end section 108, the first and intermediate sections being of approximately the same length, and the end section being slightly longer then either of the other sections. The first section 104 is connected at one border along fold line 68 to the bottom wall 38 and at the opposite border along fold line 110 to the intermediate section 106, which in turn is connected at a border along fold line 112 to the end section 108, opposite to the fold line 110 connecting the first section 104 and the intermediate section 108. The ridge 28 is formed by folding the ridge-forming flap 70 along the lines 68, 110, and 112 such that the end section 108 lies within the box 22 adjacent to and approximately parallel with the bottom wall 38 and such that the very end of the ridge-forming flap 70 rests near the fold line 68. When the ridge-forming flap 70 is in this folded position, the first section 104 and the second section 106 form the ridge 28 the apex of which is the fold line 110. Those skilled in the art will readily appreciate that numerous other kinds of ridges 28 may be made, regardless of where the discharge opening 26 is located and that a wide variety of means (including the weight of the web 12) may be used if needed to maintain the ridge-forming flap 70 in the folded condition.

When the web 12 is contained in the box 22, the web trailing end is preferably connected by a web extension ribbon and attached by suitable means to the box 22. As shown in FIGS. 8–13, a web extension ribbon 114 may be attached to a "C" shaped connector 116 formed of folded corrugated paper or cardboard, which connector 116 is adapted to grasp the end section 108 of the ridge-forming flap 70 to thereby secure the web extension ribbon 114 to the box 22.

The box 22 has been described with reference to contents in web form, however, it should be understood that such a box may be utilized with contents in non-web form (e.g., soap powder), whereby the ridge would inhibit the flow of the non-web contents through the discharge opening.

Although particular embodiments of the present invention have been described and illustrated herein, it should be recognized that modifications and variations may readily occur to those skilled in the art and that such modifications and variations may be made without departing from the spirit and scope of my invention. Accordingly, all such modifications and variations are included in the scope of the invention as defined by the following claims.

I claim:

1. An improved point-of-sale article display and dispensing device for small easily pilfered articles comprising an elongate boxlike receptacle having a front wall available for the display of promotional material, means for mounting said receptacle at a predetermined elevation above and closely adjacent a checkout counter at a retail store, an elongate article delivery slot in the lower portion of said front wall of said boxlike receptacle to effect article delivery without impairment of visual access to said front wall, a plurality of article storage and dispensing containers sized to be removably disposed in side-by-side relation within said boxlike receptacle for point of sale presentation of variegated articles, each of said article storage and dispensing containers containing an elongate web having a series of articles to be dispensed mounted in longitudinal spaced relation thereon and an aperture adjacent one corner thereof for progressive lineal removal of said article supporting web therefrom, said apertures in said article storage and dispensing containers being selectively located for disposition in aligned abutting relationship with the article delivery slot in said boxlike receptacle when said article storage and dispensing containers are disposed in operative article dispensing relation therewithin, and resiliently deformable means associated with said elongate delivery slot in said receptacle for selectively compressively engaging said article supporting webs to resiliently restrain web passage therethrough.

2. An article display and dispensing device as set forth in claim 1 wherein said article storage and dispensing container further includes an internal transverse ridge requiring web elevation and depression disposed in the path of advance of said article supporting web adjacent to said aperture for inhibiting passage of said web therepast.

3. An article display and dispensing device as set forth in claim 1 wherein said article storage and dispensing container further includes a foldable flap member at least partially integral with said container and selectively foldably deformable to provide an internal transverse ridge requiring web elevation and depression disposed in the path of advance of said article supporting web adjacent to said aperture for inhibiting passage of said web therepast.

4. An article display and dispensing device as set forth in claim 3 wherein the trailing end of said web is connected to said flap.

5. An article display and dispensing device as set forth in claim 1 wherein said resiliently deformable means associated with said elongate delivery slot comprises a pair of generally parallel, surface deformable roller members for each article delivery web displaceable therepast.

6. An article display and dispensing device as set forth in claim 1 wherein said resiliently deformable means associated with said elongate delivery slot includes means for varying the transverse dimension of said slot to accommodate articles of varying transverse dimension passable therethrough.

* * * * *